US006006059A

United States Patent [19]

Till et al.

[11] Patent Number: 6,006,059

[45] Date of Patent: Dec. 21, 1999

[54] FUNCTION-SEPARATED VACUUM-ASSISTED BLOTTER FOR LIQUID DEVELOPMENT IMAGE CONDITIONING

[75] Inventors: Henry R. Till, East Rochester; David H. Pan, Rochester; Shu Chang, Webster; Rasin Moser, Fairport; Terry D. Seim; Paul W. Morehouse, Jr., both of Webster, all of N.Y.

[73] Assignee: Xerox Corporation, Stamford, Conn.

[21] Appl. No.: 08/925,448

[22] Filed: Sep. 8, 1997

[51] Int. Cl.[6] ..... G03G 15/10

[52] U.S. Cl. ..... 399/249

[58] Field of Search ..... 399/249, 348; 430/117, 118

[56] References Cited

U.S. PATENT DOCUMENTS

| | | | |
|---|---|---|---|
| 3,955,533 | 5/1976 | Smith et al. | 399/249 |
| 4,286,039 | 8/1981 | Landa et al. | 430/119 |
| 5,332,642 | 7/1994 | Simms et al. | 430/125 |
| 5,424,813 | 6/1995 | Schlueter, Jr. et al. | 399/249 X |
| 5,481,341 | 1/1996 | Sypula et al. | 399/249 X |
| 5,752,144 | 5/1998 | Mammino et al. | 399/249 |
| 5,841,456 | 11/1998 | Takei et al. | 399/249 X |

*Primary Examiner*—William J. Royer
*Attorney, Agent, or Firm*—Aditya Krishnan

[57] ABSTRACT

A method and apparatus for improving the quality of an image that has been developed by a liquid carrier is disclosed. Generally speaking, the invention is a blotter roll which includes an absorbing layer wrapped around a non-permeable rigid core. A vacuum system communicates with the exterior surface of the blotter roll to remove the excess fluid from the blotter roll and transport it out of the printing system.

19 Claims, 4 Drawing Sheets

FUNCTION-SEPARATED VACUUM-ASSISTED BLOTTER FOR LIQUID DEVELOPMENT IMAGE CONDITIONING

The present invention is directed to a method and apparatus for improving the quality of an image that is developed by a liquid carrier.

BACKGROUND OF THE INVENTION

Generally, the process of electrostatographic copying is initiated by exposing a light image of an original document to a substantially uniformly charged photoreceptive member. Exposing the charged photoreceptive member to a light image discharges its surface in areas which correspond to non-image areas in the original document while maintaining the charge in image areas. This selective discharging scheme results in the creation of an electrostatic latent image of the original document on the surface of the photoreceptive member. This latent image is subsequently developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the latent image for forming a powder toner image on the photoreceptive member.

Alternatively, liquid developer materials comprising a liquid carrier material having toner particles dispersed therein have been utilized. In a process such as this, the developer material is applied to the latent image with the toner particles being attracted toward the image areas to form a liquid image. Regardless of the type of developer material employed, the toner particles of the developed image are subsequently transferred from the photoreceptive member to a copy sheet, either directly or by way of an intermediate transfer member. Once on the copy sheet, the image may be permanently affixed to provide a "hard copy" reproduction of the original document or file. The photoreceptive member is then cleaned to remove any charge and/or residual developing material from its surface in preparation for subsequent imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, in contradistinction to the light lens generated image systems which develop toner on the charged areas, knows as CAD, or "write white" systems. The subject invention applies to both such systems.

When using liquid toners, there is a need to remove the liquid carrier medium from the photoconductive surface after the toner has been applied thereto. This prevents the liquid carrier from being transferred from the photoreceptor to the paper or to the intermediate medium during image transfer. Removing the liquid carrier also allows it to be recovered for recycle and reuse in the developer system. This provides for additional cost savings in terms of printing supplies, and helps eliminate environmental and health concerns which result from disposal of excess liquid carrier medium.

One known method of removing excess carrier fluid from a developed image requires placing a blotter roll in rotatable contact with the image while it resides on the photoreceptor or intermediate substrate. The blotter roll will typically be made from an absorbent material, which allows the excess carrier fluid to be drawn from the surface of the belt and into the contacting roll. The fluid is then removed from the roll via a vacuum applied to the interior cavity of the roll. Removal of carrier fluid from the surface of the image results in an increase in solid particle content, thereby allowing for greater efficiency of the process of transferring the image from the photoreceptor to the intermediate substrate or from the intermediate substrate to permanent media. The solid content of the toner particles can be increased even further if a High Solids Image Conditioning (HSIC) unit (which includes a high pressure blotter roll) is used.

The most efficient conditioning of an image to increase the percentage of solids residing therein obviously requires preventing the solid toner particles from leaving the image while removing carrier liquid. Successful image conditioning also requires electrostatic forces to hold or stabilize the toner particles in order to increase the clarity and resolution of the toner image. In addition, the carrier liquid removal device must also remain clean and free of toner particles so as to prevent it from thereafter contaminating a subsequent image with embedded toner particles.

Various techniques and devices have been devised for conditioning the liquid developer image by using blotter rolls or rollers to remove carrier liquid from the image as discussed above. Using one method, the developed image containing approximately 8% to 1 0% solid particles is first subjected to treatment by a Low Solids Image Conditioner (LSIC) which increases the percentage of solids to approximately 14% to 20%, while increasing the stability of the image, and reducing the thickness of the background fluid. High Solids Image Conditioning (HSIC) is then applied in order to increase the solid particle content to approximately 40%–45%, enabling the image to be transferred and fixed to a final substrate, without removing solid particles along with the carrier fluid. While applying high pressure has been quite effective in increasing the solid particle content, it unfortunately also results in offset of a substantial amount of the image to the blotter surface when the input image reaches higher toner concentrations. Thus, it is advantageous to devise a way in which the solid particle content of an image developed using a liquid material may be substantially increased without requiring a high pressure to be applied to the surface of the image. In addition, it is advantageous to remove the fluid from the blotter roll by applying a vacuum to it externally rather than internally because elimination of the hollow interior cavity increases the strength of the roll and decreases the costs of manufacturing it. Applying the vacuum externally also helps to keep the conditioning roll clean.

The following disclosures may be relevant to various aspects of the present invention:

U.S. Pat. N. 5,481,341 to Sypula et al., issued Jan. 2, 1996, discloses a roller for controlling the application of carrier liquid to an image bearing member in an electrostatographic reproduction apparatus having a rigid porous electroconductive supportive core, a conformable microporous covering provided around the core, and a pressure controller. The pressure controller is located to provide a positive or negative pressure within the porous core and across a cross section of the core and covering.

U.S. Pat. No. 5,424,813 to Schlueter et al., issued Jun. 13, 1995, and having a common assignee as the present application discloses a roller comprising an absorption material and a covering, which are adapted to absorb carrier liquid from a liquid developer image. The covering has a smooth surface with a plurality of perforations, to permit carrier liquid to pass through to the absorption material at an increased rate, while maintaining a covering having a smooth surface which is substantially impervious to toner particles yet pervious to carrier liquid so as to inhibit toner particles from departing the image.

U.S. Pat. No. 5,332,642 to Sims et al., issued Jul. 26, 1994, having a common assignee as the present application, discloses a porous roller for increasing the solids content of an image formed from a liquid developer. The liquid dispersant absorbed through the roller is vacuumed out through a central cavity of the roller. The roller core and/or the absorbent material formed around the core may be biased with the same charge as the toner so that the toner is repelled from the roller while the dispersant is absorbed.

U.S. Pat. No. 4,286,039 to Landa et al., issued Aug. 25, 1981, discloses an image forming apparatus comprising a deformable polyurethane roller, which may be a squeegee roller or blotting roller which is biased by a potential having a sign the same as the sign of the charged toner particles in a liquid developer. The bias on the polyurethane roller is such that it prevents streaking, smearing, tailing or distortion of the developed electrostatic image and removes much of the carrier liquid of the liquid developer from the surface of the photoconductor.

All of the references cited herein are incorporated by reference for their teachings.

Accordingly, although known apparatus and processes are suitable for their intended purposes, a need remains for alternative methods to condition images that have been developed by liquid developer material to increase their solid content before transfer to an output copy sheet.

SUMMARY OF THE INVENTION

In accordance with the present invention, there is provided a fluid removal system for removing carrier liquid from the surface of an image bearing member, which includes an absorbing roller in fluid communication with a developed image; and a vacuum application system in fluid communication with the absorbing roller, the vacuum system being external to the absorbing roller.

In accordance with yet another aspect of the invention, there is provided a fluid removal system for removing carrier liquid from the surface of an image bearing member, which includes an absorbing roller having a core made from a rigid, fluid impermeable material, and an absorbing layer surrounding the core; and a vacuum application system including a roller which applies a negative pressure to the absorbing roller.

In accordance with still another embodiment of the invention there is provided an electrophotographic printing system including a movable image carrying member which transports a latent image; a developer station which deposits toner material on the latent image to create a developed image, the toner material being immersed in a liquid carrier; a transfer station for transferring the developed image to a receiving medium; an absorbing roller, placed between the developer station and the transfer station, which is capable of absorbing liquid carrier from the latent image, the absorbing roller including an absorbing outer layer surrounding a rigid inner core; and a vacuum source, in fluid communication with the absorbing roller, which applies a vacuum to an exterior surface of the absorbing outer layer to cause the liquid carrier to be removed from the absorbing roller and drawn into the vacuum source.

Liquid developers have many advantages, and often produce images of higher quality than images formed with dry toners. For example, images developed with liquid developers can be made to adhere to paper without a fixing or fusing step, thereby eliminating a requirement to include a resin in the liquid developer for fusing purposes. In addition, the toner particles can be made to be very small without resulting in problems often associated with small particle powder toners, such as airborne contamination which can adversely affect machine reliability and can create potential health hazards. Development with liquid developers in full color imaging processes also has many advantages, including, among others, production of a texturally attractive output document due to minimal multilayer toner height build-up (whereas full color images developed with dry toners often exhibit substantial height build-up of the image in regions where color areas overlap). In addition, full color imaging with liquid developers is economically attractive, particularly if surplus liquid carrier containing the toner particles can be economically recovered without cross contamination of colorants. Further, full color prints made with liquid developers can be processed to a substantially uniform finish, whereas uniformity of finish is difficult to achieve with powder toners due to variations in the toner pile height as well as a need for thermal fusion, among other factors.

BRIEF DESCRIPTION OF THE DRAWINGS

Other features and advantages of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

The present invention is directed to a method and apparatus for improving the quality of an image that is developed by a liquid carrier. More specifically, the present invention is directed to an absorbing blotter roll which removes excess carrier fluid from the surface of an image that has been developed by a liquid developer. A vacuum is applied to the outside surface of the blotter roll to remove the carrier fluid from its surface, for collection outside the printing machine.

Figure 1:
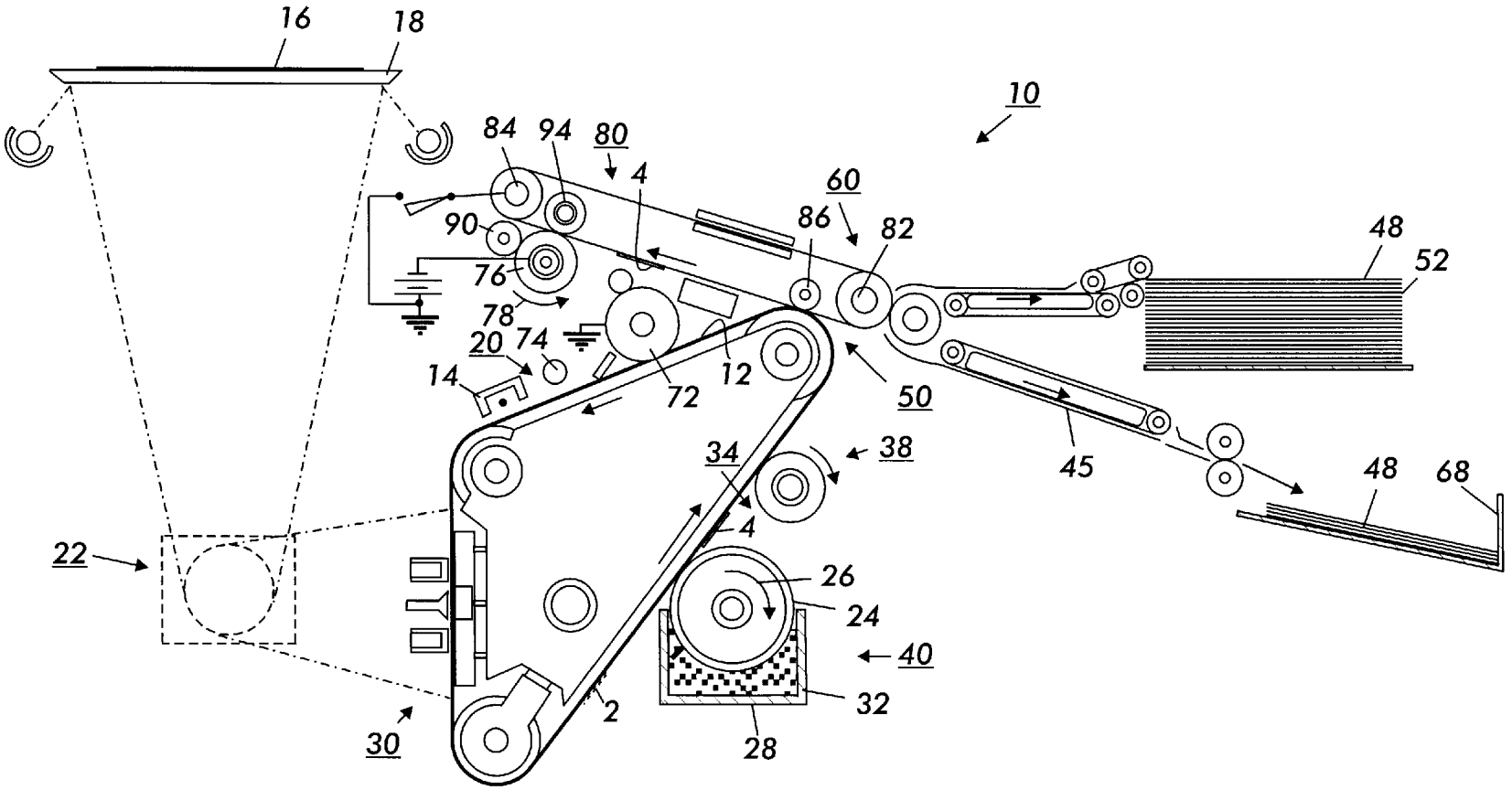
FIG. 1 contains a schematic illustration of a portion of an electrophotographic printing machine which uses an intermediate transfer belt to complete liquid image development.

Referring now to the drawings where the showings are for the purpose of describing an embodiment of the invention and not for limiting the same, in FIG. 1, reproduction machine 10 employs belt 12 having a photoconductive surface deposited on a conductive substrate. Initially, belt 12 passes through charging station 20. At charging station 20, a corona generating device 14 charges the photoconductive surface of belt 12 to a relatively high, substantially uniform potential.

Once the photoconductive surface of belt 12 is charged, the charged portion is advanced to exposure station 30. An original document 16 which is located upon a transparent support platen 18 is illuminated by an illumination assembly, indicated generally by the reference numeral 22, to produce image rays corresponding to the document information areas. The image rays are projected by means of an optical system onto the charged portion of the photoconductive surface. The light image dissipates the charge in selected areas to reveal an electrostatic latent image 2 on the photoconductive surface corresponding to the original document informational areas.

After electrostatic latent image 2 has been revealed, belt 12 advances it to development station 40. At development station 40, roller 24, rotating in the direction of arrow 26, advances a liquid developer material 28 which includes toner particles dispersed substantially throughout a carrier fluid, from the chamber of housing 32 to development zone 34. The toner particles pass by electrophoresis to electrostatic latent image 2. The charge of the toner particles is opposite in polarity to the charge on the photoconductive surface when a CAD system is used, or identical in polarity in the case of a DAD system.

Development station 40 includes Low Solids Image Conditioner (LSIC) 38. LSIC 38 encounters the developed image 4 on belt 12 and conditions it by removing and reducing its liquid content, while inhibiting and preventing the removal of solid toner particles. LSIC 38 also conditions the image by electrostatically compacting the toner particles of the image. Thus, an increase in percent solids is achieved in the developed image, thereby improving the quality of the final image.

At transfer station 50, the developed liquid image 4 is electrostatically transferred to an intermediate member or belt indicated by reference numeral 80. Intermediate belt 80 is entrained about spaced rollers 82 and 84. Bias transfer roller 86 imposes intermediate belt 80 against belt 12 to assure image transfer to the intermediate belt 80.

Developed image 4 is brought in contact with a High Solid Image Conditioning (HSIC) unit, which further increases the solid particle content of a contacting image. HSIC unit includes backing roll 94, as well as blotter roll 76 and vacuum application system 90 of the present invention. The HSIC unit conditions developed image 4 on belt 80 by electrostatically compressing it, and additionally reducing its liquid content, while preventing toner particles from departing from the image.

Figure 2:
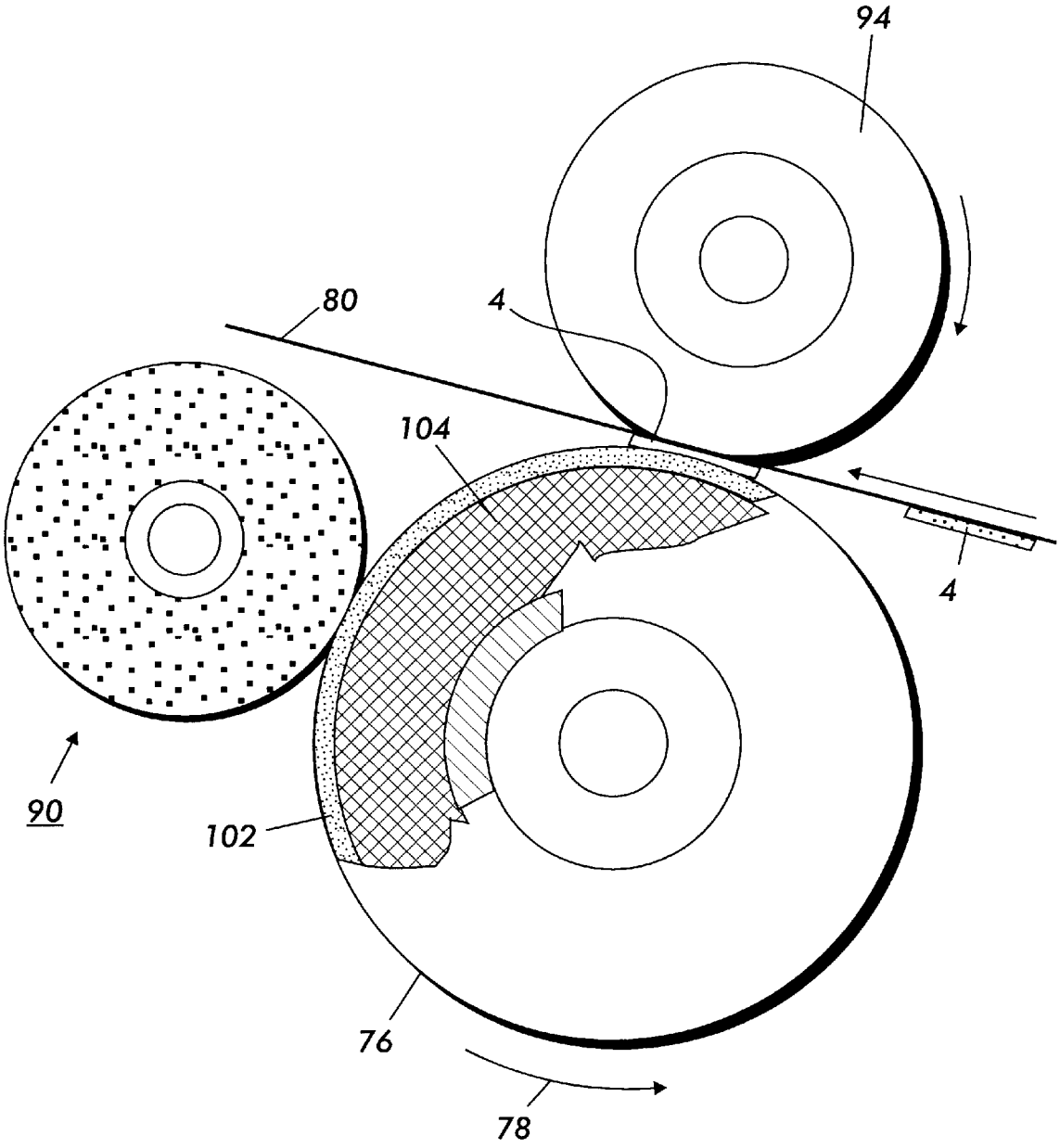
FIG. 2 contains a detailed illustration of the blotter roll placed next to the external vacuum application system of present invention.

Referring now to FIG. 2, blotter roll 76 and vacuum application system 90 remove carrier fluid from the surface of developed image 4 and transport it out of reproduction machine 10 for recycling or for collection and removal. More specifically belt 80, supported by backing roll 94 on its inside surface, transports developed image 4 past the HSIC unit. Blotter roll 76 is brought in contact with developed image 4 directly across from backing roll 94, causing carrier fluid to be absorbed from the surface of belt 80. Vacuum application system 90 then draws carrier fluid from blotter roll 76 and transports it away from the imaging system.

In one embodiment of the invention, blotter roll 76 is composed from a non-permeable metal core 104 surrounded by absorbing layer 102. Core 104 may be formed from any rigid substance suitable for withstanding the forces that will be applied to the image during high solid image conditioning. Examples of suitable substances include plastics, ceramics and numerous metal materials including aluminum, titanium and steel, but use of other materials in manufacturing core 104 is possible, and the invention is not limited to the use of metal or plastic.

Still referring to FIG. 2, absorbing layer 102 is formed by wrapping an open cell absorbing foam sleeve around metal core 104 such that the entire circumference of core 104 is covered. The absorption rate of absorbing layer 102 must be proportional to the process speed of the contacting intermediate belt or imaging member. In addition, it should be made from a material that satisfies most if not all of the material specifications listed in Table 1 in order to ensure successful removal of fluid from the surface of the image.

TABLE 1

| Parameter | Design Requirements | Approximate Acceptable Ranges |
|---|---|---|
| Compression Modulus | High enough to supply sufficient nip pressure, but low enough to prevent compression of the liquid image. | 50–500 psi |
| Thickness | High enough to uniformly apply nip pressure, but low enough to obtain sufficient nip pressure. | ≧.010 in |
| Resistivity | High enough to prevent electrical breakdown. | $<1.00 \times 10^9$ |
| Porosity | Low enough to prevent insufficient shore A. | <85% |
| % Saturation | Low enough to prevent re-wetting of the image. | <30 |
| Surface Energy | Low enough to prevent image offset. | <40 dynes/cm |

In one embodiment of the invention, absorbing layer 102 is a foam covering 0.016 in thick, with a compression modulus of 200 psi, and a porosity of 78%, wrapped around a cinctured aluminum core. During operation of this embodiment of blotter roll 76, approximately 10% of this foam covering became saturated and the surface energy was between 35 and 40 dynes/cm. These roll specifications serve only to show one example of blotter roll 76. It is not intended to limit the invention to a roll having these exact, or even similar dimensions. In fact, Table 1 merely gives examples of values that are known to be successful for use in the present invention. It is possible to design a blotter roll 76 such that it will successfully absorb excess fluid from the surface of a moving imaging member or intermediate belt that has one or more of the listed design criteria falling outside of the ranges listed here. It is intended to embrace these alternatives, and the invention is not limited to the above mentioned embodiments.

With continued reference to FIG. 2, vacuum application system 90 is associated with blotter roll 76 to facilitate continued removal of the carrier fluid from the roll to a container for recycling or for removal from the reproductionn or printing machine. Importantly, although vacuum system 90 may be brought in contact with blotter roll 76, it is a device separate from and external to the blotter roll 76. The vacuum applied by vacuum system 90 must be strong enough to draw fluid from blotter roll 76 at a rate that will prevent the roll from becoming too saturated to allow it to continuously remove fluid from the developed image 4. In the sample blotter roll 76 described above, the corresponding vacuum system 90 applies a negative pressure of 15 inches of mercury to the surface of the blotter roll. This level of vacuum proved to be acceptable for removing fluid from the roll at the appropriate rate. Fifteen inches of mercury is an example of a vacuum that may be applied to the above described blotter roll. It is not intended to limit either that embodiment of the invention, or any other to application of a vacuum having this strength.

Figure 3:
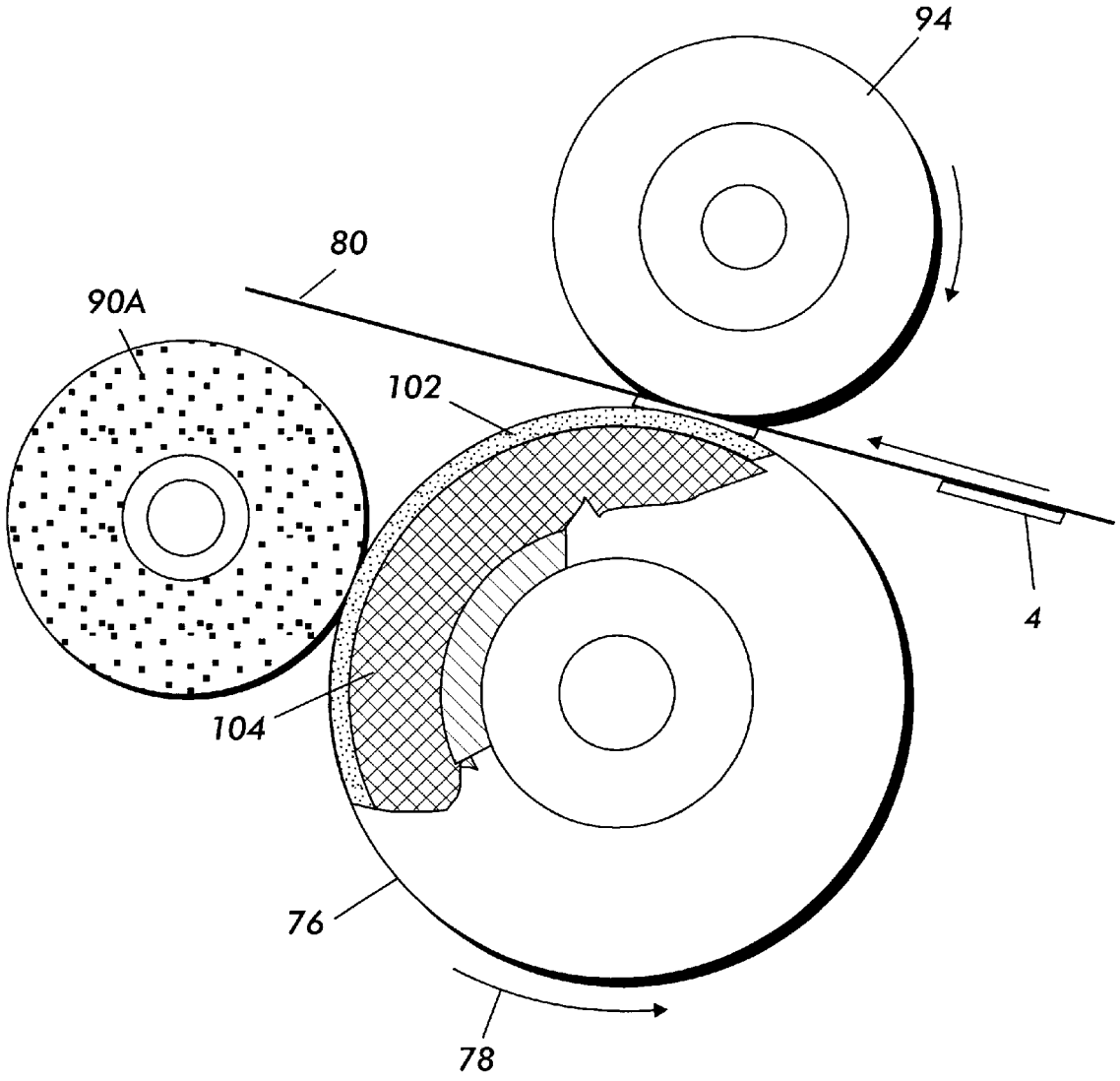
FIG. 3 contains a detailed illustration of one embodiment of the vacuum application system of the present invention.

Referring now to FIG. 3, one embodiment of vacuum application system 90 includes a roller 90A which may be brought adjacent to or in rotatable contact with blotter roll 76. In the embodiment shown, the pressure measured at the axis of roller 90A is negative relative to the outer layer of the roll. This negative pressure causes fluid to be drawn from blotter roll 76 into vacuum roll 90A, allowing the roll to continuously remove fluid from developed image 4. Removal of carrier fluid from developed images 4 can thereby continue for an indefinite period of time without saturating blotter roll 76. Thus, print operation can continue indefinitely and image development does not have to be suspended to wring or otherwise empty blotter roll 76.

Figure 4:
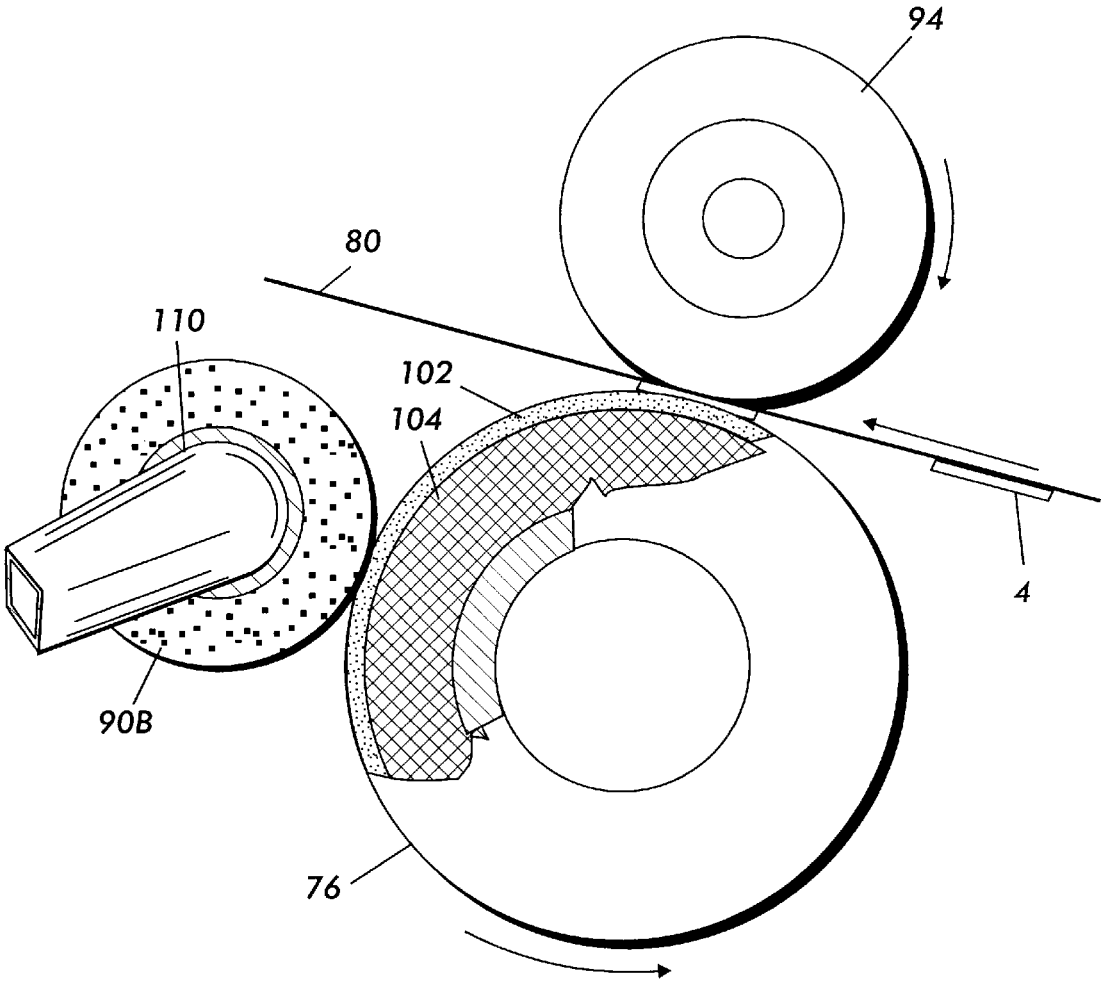
FIG. 4 contains a detailed illustration of a second embodiment of the vacuum application system of the present invention.

With reference now to FIG. 4, a second embodiment of vacuum application system 90 includes a roller 90B with an interior cavity 110. Roller 90B is made from a fluid absorbing material, and like roller 90A of FIG. 3, roller 90B is brought adjacent to or in rotatable contact with blotter roll 76. However, roller 90B is distinguished from roller 90A in that it does not, by itself, apply a negative pressure to blotter roll 76. Instead a vacuum pump (not shown) is in fluid communication with cavity 110, to cause fluid in blotter roll 76 to be drawn through the absorbing surface of roller 90B and into cavity 110. Again, rollers 90A and 90B serve as examples of vacuum system 90 that may be associated with blotter roll 76 to remove fluid therefrom. It is not intended to limit the invention to these types of vacuum applying devices, as other systems may also be successfully used.

Referring again to FIG. 1, roll 76 rotates in the direction indicated by arrow 78 to contact developed image 4 on belt 80, and allow absorbing layer 102 to soak liquid from its surface. The absorbed liquid is then drawn from the surface of blotter roll 76 by the external negative pressure being applied by vacuum system 90. After vacuum system 90 removes fluid from blotter roll 76, the fluid is transported out of the reproduction machine for recycling or removal. Roll 76 continues to rotate past subsequent developed images 4. This provides for a continuous absorption of liquid from the surface of developed image 4 as blotter roll 76 is discharged of excess liquid due to its communication with vacuum system 90.

Belt 80 then advances the developed image to transfer/fusing station 60. At transfer/fusing station 60, a copy sheet 48 is advanced from stack 52 by a sheet transport mechanism, indicated generally by the reference numeral 54. Developed image 4 on the surface of belt 80 is attracted to copy sheet 48, and is simultaneously heated and fused to the sheet by heat from roller 82, for example. After transfer, conveyor belt 45 moves the copy sheet 48 to the discharge output tray 68.

After developed image 4 is transferred to copy sheet 48, residual liquid developer material remains adhering to the photoconductive surface of belt 12. This material may be removed using any of several well known suitable cleaning means 72, and any residual charge left on the photoconductive surface may be extinguished by flooding the photoconductive surface with light from lamps 74. It should be noted that while the apparatus shown in FIG. 1 shows only a single roller 76, multiple roller stations can be utilized in conjunction with a single belt or with the transfer of multiple images to an intermediate belt 80.

It is, therefore, apparent that there has been provided in accordance with the present invention, a method and apparatus for increasing the mechanical strength of a developed liquid image that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A fluid removal system for removing carrier liquid from the surface of an image bearing member, comprising:

a) an absorbing roller in fluid communication with a developed image; and b) a vacuum application system in fluid communication with said absorbing roller, said vacuum application system being external to said absorbing roller wherein said vacuum application system further comprises a roller which applies a negative pressure to said absorbing roller.

2. A fluid removal system as claimed in claim 1 wherein said roller further comprises a cylindrical, fluid permeable substance, said fluid permeable substance having a capillary pressure measured at an axis of said roller, relative to an outside surface of said roller, said capillary pressure being negative.

3. A fluid removal system as claimed in claim 1 wherein said roller further comprises:

a) a fluid permeable substance with an interior cavity; and b) a vacuum communicating with said interior cavity.

4. A fluid removal system as claimed in claim 1 wherein said absorbing roller further comprises:

a) a core made from a rigid, fluid impermeable material; and b) an absorbing layer surrounding said core, said absorbing layer made from a material having a compression modulus, a thickness, a resistivity, a porosity, a saturation percentage, and a surface energy.

5. A fluid removal system as claimed in claim 4, wherein said core is made from a metal material.

6. A fluid removal system as claimed in claim 5, wherein said metal material is aluminum.

7. A fluid removal system as claimed in claim 4, wherein said core is made from a plastic material.

8. A fluid removal system as claimed in claim 4, wherein said core is made from a ceramic material.

9. A fluid removal system as claimed in claim 4, wherein said absorbing layer is made from an open cell absorbing foam sleeve.

10. A fluid removal system as claimed in claim 4 wherein said absorbing layer thickness is greater than or equal to approximately 0.010 inches.

11. A fluid removal system as claimed in claim 4 wherein said absorbing layer compression modulus is between approximately 50 psi and approximately 500 psi.

12. A fluid removal system as claimed in claim 11 wherein said absorbing layer compression modulus is equal to approximately 200 psi.

13. A fluid removal system as claimed in claim 4 wherein said resistivity is less than approximately $1.00\times10^{9}$.

14. A fluid removal system as claimed in claim 4 wherein said porosity is less than approximately 85%.

15. A fluid removal system as claimed in claim 14 wherein said absorbing layer porosity is equal to approximately 78%.

16. A fluid removal system as claimed in claim 4 wherein said surface energy is less than approximately 40 dynes/cm.

17. A fluid removal system as claimed in claim 16 wherein said absorbing layer surface energy is between approximately 35 dynes/cm and approximately 40 dynes/cm.

18. A fluid removal system as claimed in claim 4 wherein said absorbing layer thickness is equal to approximately 0.010 inches, said compression modulus is equal to approximately 200 psi, said porosity is equal to approximately 78%, and said surface energy is between approximately 35 dynes/cm and approximately 40 dynes/cm.

19. An electrophotographic printing system comprising:

a) a movable image carrying member which transports a latent image;

b) a developer station which deposits toner material on said latent image to create a developed image, said toner material being immersed in a liquid carrier;

c) a transfer station for transferring said developed image to a receiving medium;

d) an absorbing roller, placed between said developer station and said transfer station, which is capable of absorbing liquid carrier from said latent image, said absorbing roller including an absorbing outer layer surrounding a rigid inner core; and e) a vacuum source, in fluid communication with said absorbing roller, which applies a vacuum to an exterior surface of said absorbing outer layer to cause said liquid carrier to be removed from said absorbing roller and drawn into said vacuum source.

* * * * *